US009210953B2

(12) United States Patent
Horton

(10) Patent No.: US 9,210,953 B2
(45) Date of Patent: Dec. 15, 2015

(54) ARTICLE OF CLOTHING HAVING MAGNETIC FASTENING ASSEMBLIES

(71) Applicant: Maura M. Horton, Raleigh, NC (US)

(72) Inventor: Maura M. Horton, Raleigh, NC (US)

( * ) Notice: Subject to any disclaimer, the term of this patent is extended or adjusted under 35 U.S.C. 154(b) by 61 days.

(21) Appl. No.: 13/674,542

(22) Filed: Nov. 12, 2012

(65) Prior Publication Data

US 2014/0130233 A1 May 15, 2014

(51) Int. Cl.
*D05B 3/00* (2006.01)
*A41B 1/10* (2006.01)
*A41F 1/00* (2006.01)

(52) U.S. Cl.
CPC . *A41B 1/10* (2013.01); *A41F 1/002* (2013.01); *A44D 2203/00* (2013.01)

(58) Field of Classification Search
CPC ..... A41B 1/10; A41F 1/002; A44D 2203/00
USPC ..... 2/69, 265; 24/303, 379.1, 114.7
See application file for complete search history.

(56) References Cited

U.S. PATENT DOCUMENTS

| | | | | |
|---|---|---|---|---|
| 1,993,717 | A | 3/1935 | Hemmerich | |
| 2,389,298 | A | 11/1945 | Ellis | |
| 3,111,737 | A | 11/1963 | Heil | |
| 3,141,216 | A | 7/1964 | Brett | |
| 4,249,267 | A | 2/1981 | Voss | |
| 5,782,191 | A * | 7/1998 | Wong | 112/441 |
| 6,163,889 | A * | 12/2000 | Tate | 2/209.13 |
| 6,226,842 | B1 | 5/2001 | Wong | |
| 6,378,174 | B1 | 4/2002 | Wong | |
| 7,065,841 | B2 | 6/2006 | Sjoquist | |
| 2002/0178551 | A1 * | 12/2002 | Hsu | 24/303 |
| 2003/0019008 | A1 | 1/2003 | Prather | |
| 2004/0216212 | A1 | 11/2004 | Newman et al. | |
| 2005/0108803 | A1 | 5/2005 | Ballard | |
| 2010/0167619 | A1 | 7/2010 | Adamus | |
| 2010/0281597 | A1 | 11/2010 | Lang | |
| 2012/0144544 | A1 | 6/2012 | Telfer et al. | |

OTHER PUBLICATIONS

"A Tailored Suit—American Custom Clothier—Men's Suits, Custom Shirts, Mens Sports Jackets & Bespoke Blazers—Custom Clothing Style & Fashion Guide." A Tailored Suit American Custom Clothier Mens Suits Custom Shirts Mens Sports Jackets Bespoke Blazers Custom Clothing Style Fashion Guide. N.p., n.d. Web. May 13, 2015.*

"Edge Finish Stitching." Www.Garmento.org Stitch and Seam Guide;. N.p., n.d. Web. May 13, 2015.*

* cited by examiner

*Primary Examiner* — Nathan Durham
*Assistant Examiner* — Sally Haden
(74) *Attorney, Agent, or Firm* — Wood, Herron & Evans, LLP

(57) ABSTRACT

An article of clothing, such as a dress shirt, blouse, coat or jacket, includes a sheet of material forming a body portion. First and second plackets are formed along respective first and second end portions of the sheet of material. First and second magnetic elements are secured inside first and second pockets, respectively, such that positions of the plurality of second magnetic elements correspond to positions of the plurality of first magnetic elements.

23 Claims, 8 Drawing Sheets

ARTICLE OF CLOTHING HAVING MAGNETIC FASTENING ASSEMBLIES

TECHNICAL FIELD OF THE INVENTION

This invention relates to apparel and, more particularly, to a dress shirt, coat, jacket or blouse having multiple magnetic fastening assemblies.

BACKGROUND OF THE INVENTION

Typical coats, jackets, dress shirts and/or women's blouses are closed around a person's body by a series of buttons that are secured in corresponding button holes. The cuffs of dress shirts or blouses may also have closures with one or more buttons and button holes. To put a dress shirt or blouse on, the buttons must be pushed through the button holes. And to take the dress shirt or blouse off, the buttons must be pushed back out of (or pulled through) the button holes. Pushing the buttons through the relatively small button holes requires dexterity, and, thus, those who have limited control of their hands or fingers due to illness may experience difficulty closing and/or unfastening dress shirts or blouses. Young children having limited experience putting on clothing, or elderly individuals lacking full control of their hands, may also have difficulty putting on or taking off a jacket, coat, dress shirt or blouse.

It is therefore an objective of this invention to provide an article of clothing, such as a dress shirt, blouse, coat or jacket which may be quickly and easily put on and taken off by individuals, particularly those individuals having limited dexterity in their hands and/or fingers.

It is another objective of this invention to provide an article of clothing, such as a dress shirt, blouse, coat or jacket which may be quickly and easily put on or taken off, without passing buttons through holes.

It is another objective of this invention to provide an article of clothing, such as a dress shirt, blouse, coat or jacket, which uses multiple magnetic fastening assemblies to enable a person to quickly and easily put on or take off the article of clothing.

SUMMARY OF THE INVENTION

The invention of this application which accomplishes these objectives comprises an article of clothing, such as a dress shirt, blouse, coat or jacket having multiple magnetic fastening assemblies. The article of clothing includes a sheet of material or fabric that forms a body portion of the article. The sheet of material has first and second end portions. First and second plackets are formed along the first and second end portions, respectively. The first placket is formed by folding the sheet along the first end portion and securing the sheet to itself so as to form a first pocket. The second placket is formed by twice folding the sheet along the second end portion and securing the sheet to itself so as to form a second pocket. The article of clothing further includes a plurality of spaced magnetic fastening assemblies, which include a plurality of first magnetic elements secured inside the first pocket and a plurality of second magnetic elements secured inside the second pocket. The first and second magnetic elements may be secured in the pockets by stitching together the surrounding layers. Thus, the first and second magnetic elements may be solid pieces. Positions of the plurality of second elements correspond to positions of the plurality of second elements. The first and second magnetic elements magnetically couple together in an engaged configuration. As a result of the positioning of the first and second magnetic elements within the respective first and second pockets, at least two layers of material lie between the first and second magnetic elements in the secured configuration.

The article of clothing may also use a similar fastening assembly at a cuff of the article. The cuff may include a band of material having first and second end portions and inner and outer layers. The inner and outer layers are secured together so as to form a pocket between the layers. The cuff also includes a magnetic fastening assembly having first and second magnetic elements. The first magnetic element is secured in the pocket at the first end portion of the band, and the second magnetic element is secured in the pocket at the second end portion of the band.

The magnetic fastening assemblies may also include a plurality of buttons coupled to the second placket on the main body portion of the article of clothing and/or on the cuff band. However, as the magnetic fastening assembly has a magnetic engagement, the purpose of the buttons is aesthetic—to provide the appearance of a regular shirt, blouse, coat or jacket.

In order to fasten the main body and/or the cuff of the article of clothing, one positions his arms in the sleeves of the article. He/she then aligns a first magnetic element with a corresponding second magnetic element and brings these first and second magnetic elements in close proximity so that they couple together. With respect to the fastening assembly of the main body portion, when an uppermost first element is magnetically coupled to an uppermost second element, first and second elements of the magnetic assemblies positioned below the uppermost first and second elements are configured to self-align and couple together. Thus, a person with limited dexterity may quickly and easily put on an article of clothing, such as a dress shirt, blouse, coat or jacket quickly and easily without assistance.

These and other advantages of the present invention will more readily become apparent from the description of the drawings herein, in which:

DETAILED DESCRIPTION OF THE INVENTION

Figure 1:
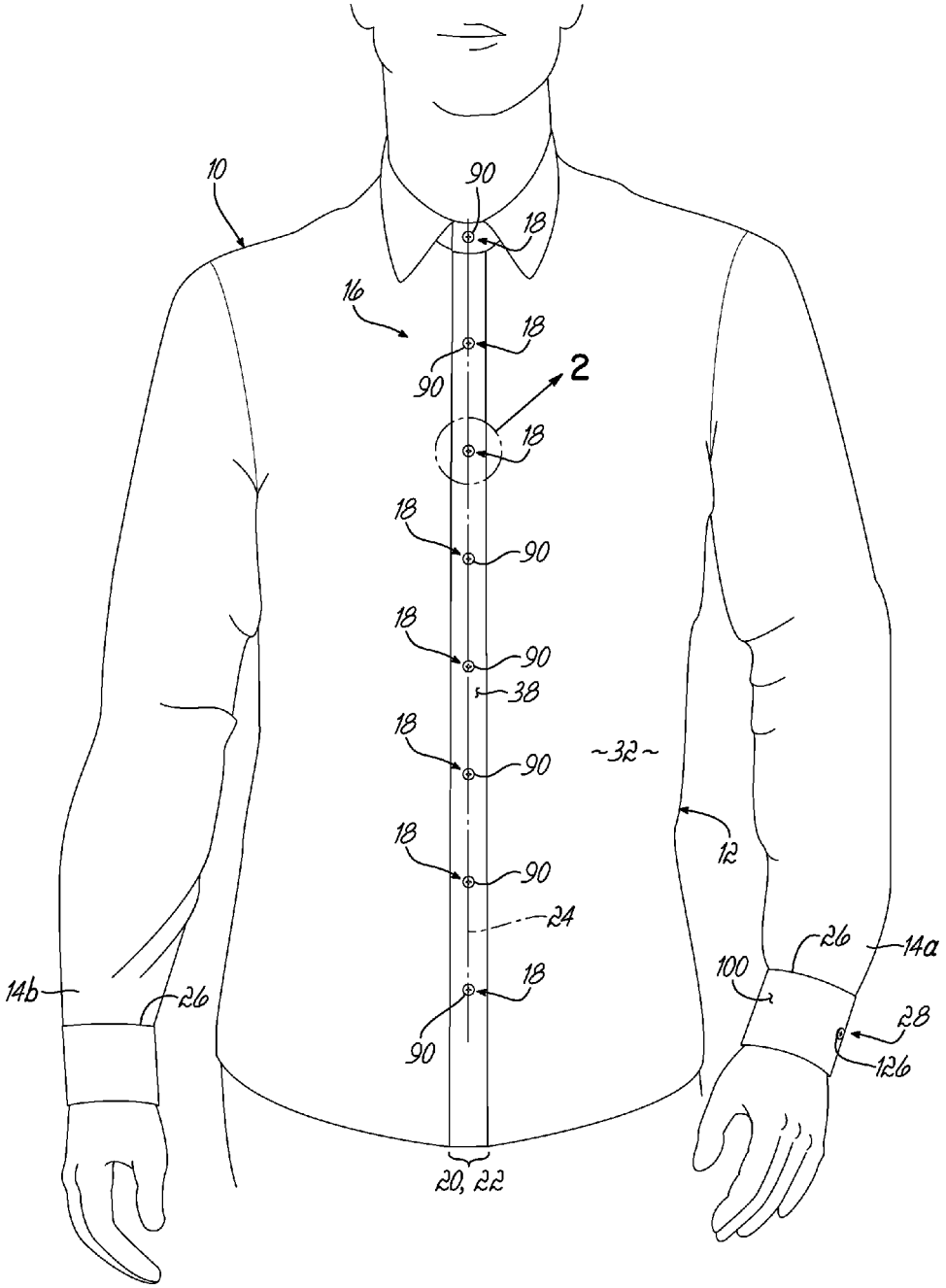
FIG. 1 is a front view of an article of clothing, such as a men's dress shirt according to aspects of the present invention.
Figure 1A:
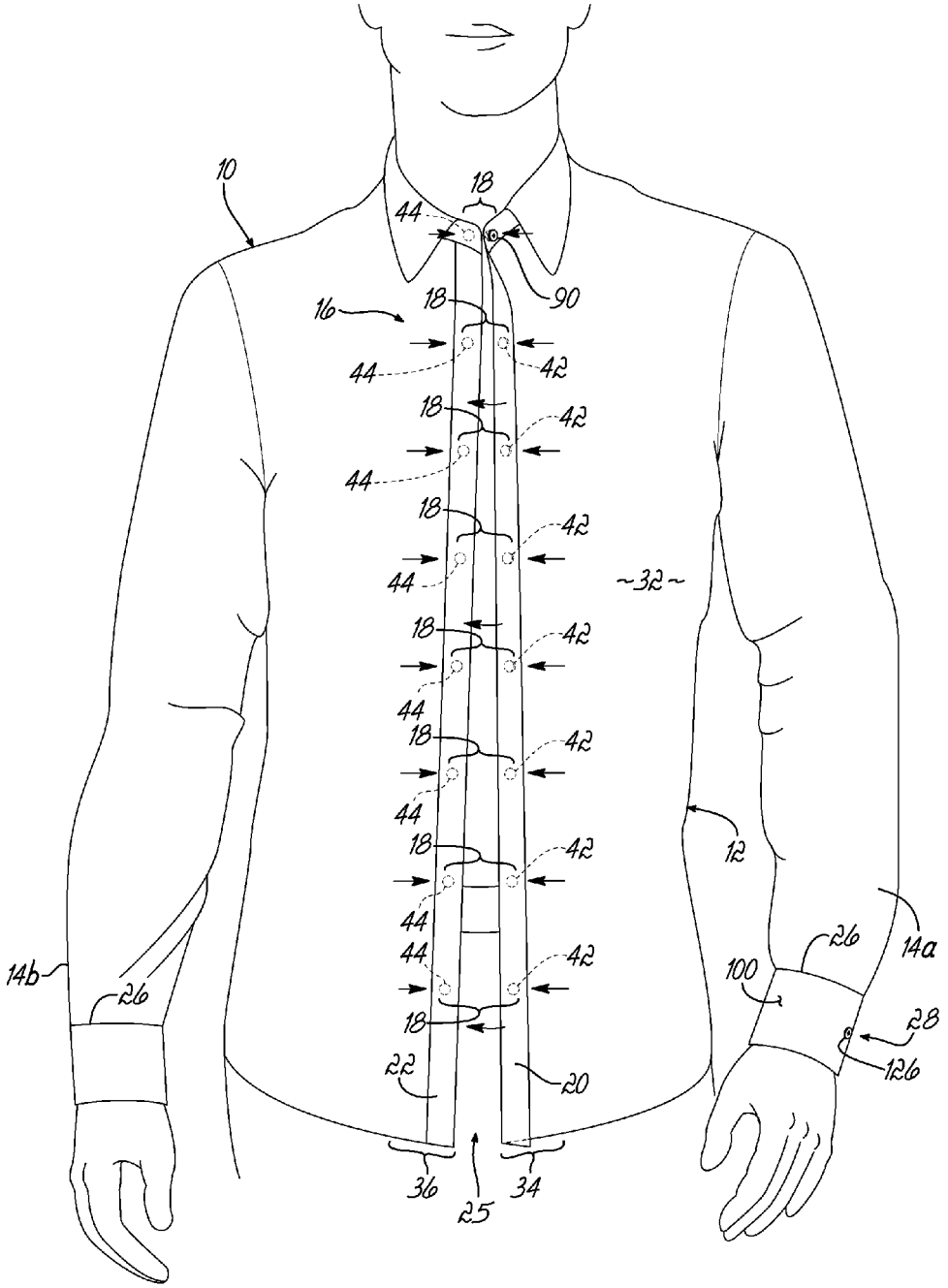
FIG. 1A is a front view of the men's dress shirt of FIG. 1 in which a plurality of magnetic fastening assemblies along a midline of the shirt are disengaged.

Referring to FIG. 1, an article of clothing 10 has a body portion 12 and two sleeves; a left sleeve 14*a* and a right sleeve 14*b*. The article of clothing 10 is illustrated as being a men's dress shirt, but may be a coat or jacket or similar article of clothing. On the body portion 12, a fastening assembly 16 has a plurality of magnetic fastening assemblies 18 positioned along plackets 20, 22 that run down a midline 24 of the article of clothing 10. As shown in FIG. 1A, the left side of the shirt has placket 20 and the right side of the shirt has placket 22. Although the embodiment shown in FIGS. 1 and 1A includes eight magnetic fastening assemblies 18 along the midline 24 of the article 10, the number of magnetic fastening assemblies 18 may vary depending on the size and style of the article 10, for example. In FIG. 1, all of the magnetic fastening assemblies 18 are engaged so as to close the article 10 around a person's body, the placket 20 overlying placket 22 so left placket 20 is outside right placket 22. In FIG. 1A, the magnetic fastening assemblies 18 are disengaged, so the article 10 is in an open position.

The article 10 may have a cuff 26 at the distal end of each sleeve 14*a*, 14*b*. Each cuff 26 may include at least one magnetic fastening assembly 28. Similar to the fastening assembly 16 along the midline 24 of the article 10, the number of magnetic fastening assemblies 28 on each cuff 26 may vary according to the size and style of the cuffs 26.

With further reference to FIGS. 1 and 1A, the main body portion 12 of the article 10 may be formed of a sheet of material or fabric 32 that is sized to fit around a person's body. As shown in FIG. 1A, the sheet of material 32 has end portions 34, 36 that form an opening 25 down the ventral portion of the article 10 when the article is open. The fastening assembly 16 includes plackets 20, 22 on the end portions 34, 36, respectively, of the sheet of material 32. The end portion 34 of the material 32 is on the left side of the shirt or article 10 proximate left sleeve 14*a*, and the end portion 36 of the material 32 is on the right side of the shirt or article 10 proximate right sleeve 14*b*.

Figure 2:
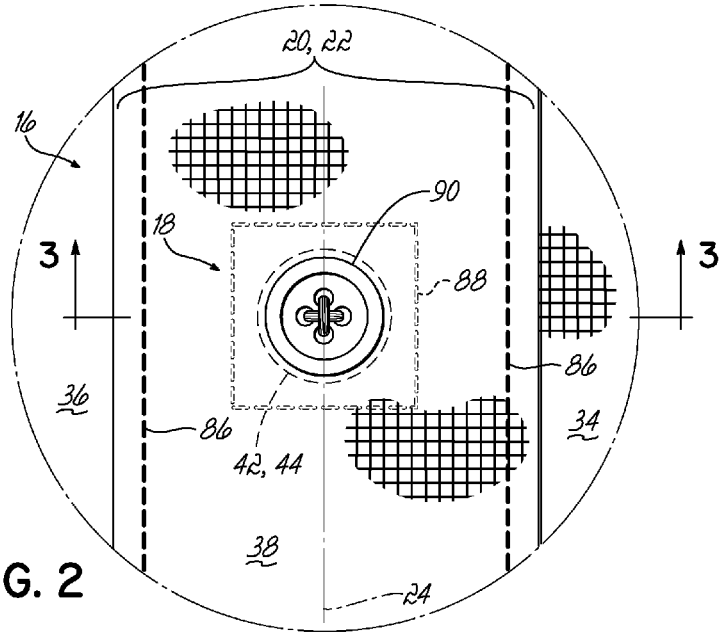
FIG. 2 is a magnified view of a portion of one of the magnetic fastening assemblies at encircled area 2 of FIG. 1.
Figure 3:
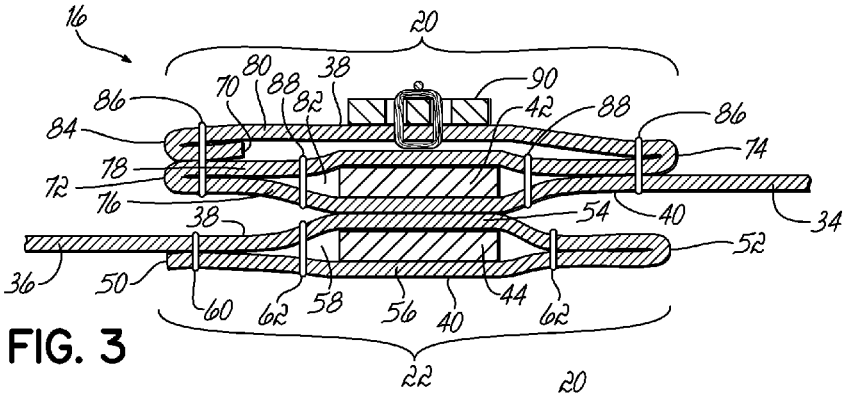
FIG. 3 is a cross-sectional view taken along line 3-3 of FIG. 2.
Figure 3A:
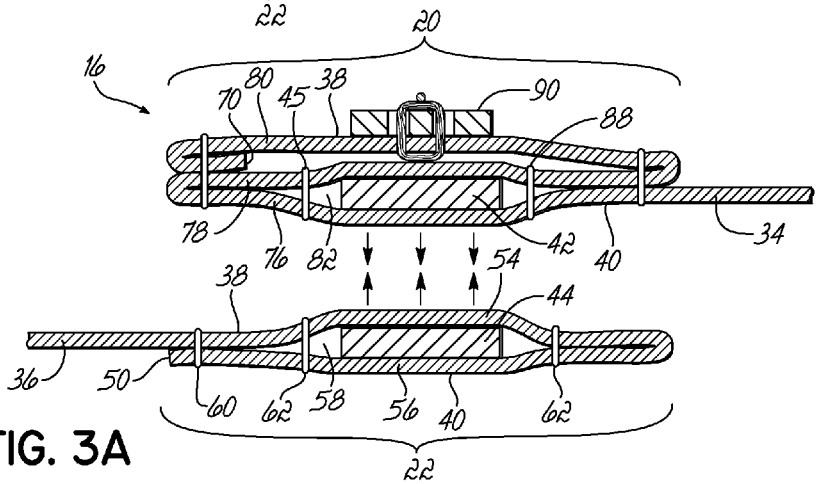
FIG. 3A is a cross-sectional view of the portion of the magnetic fastening assembly of FIG. 2A just prior to engagement.

As shown in FIGS. 2, 3 and 3A, each placket 20, 22 has an exterior surface 38, which faces away from the person's body, and an interior surface 40, which faces the person's body. The plackets 20, 22 may be integrally formed on the main body portion 12 of the article 10 by folding over end portions 34, 36 of the sheet of material 32, so as to form French plackets. Alternatively, the plackets 20, 22 may comprise separate strips of material that are sewn onto or otherwise coupled to the sheet of material 32. Each placket 20, 22 may comprise two or more layers of material that are sewn or otherwise coupled together. By having two or more layers, the plackets 20, 22 are reinforced and may have increased durability. On article 10, the left placket 20 is designed to be positioned on top of the right placket 22 in the closed position. In this way, when in a closed position, the interior surface 40 of the left placket 20 faces and is positioned substantially adjacent to the exterior surface 38 of the right placket 22. Due to the magnetic function of the fastening assembly 16, the plackets 20, 22 may be solid pieces of material, without button holes therethrough.

Figure 2A:
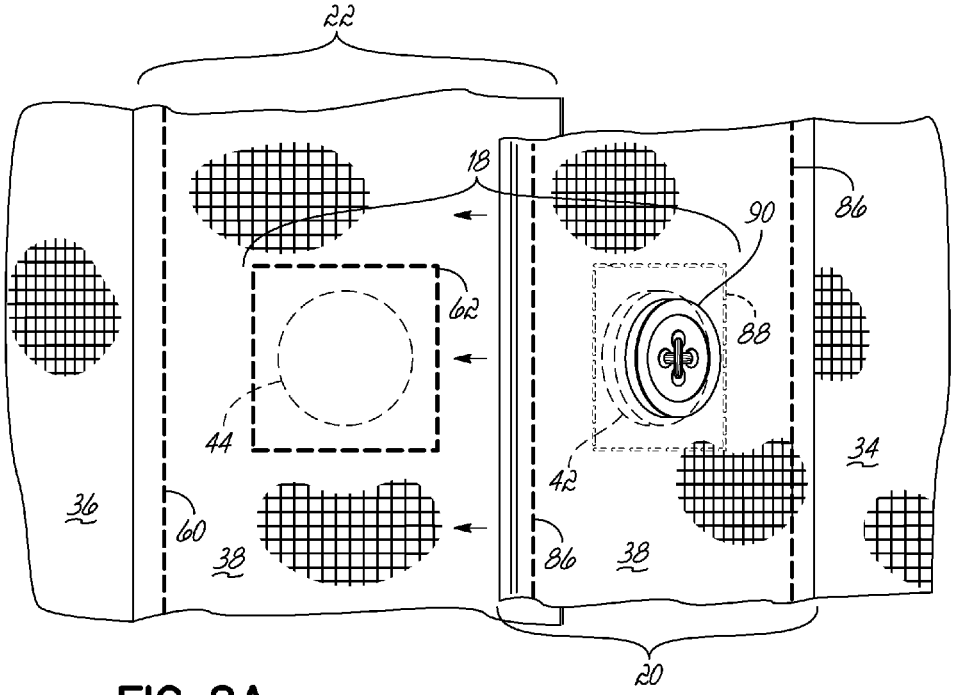
FIG. 2A is a magnified view of the portion of the magnetic fastening assembly of FIG. 2 in a disengaged configuration.
Figure 6:
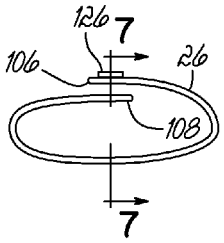
FIG. 6 is a schematic cross sectional view of a full cuff similar to that shown in FIG. 4.
Figure 7:
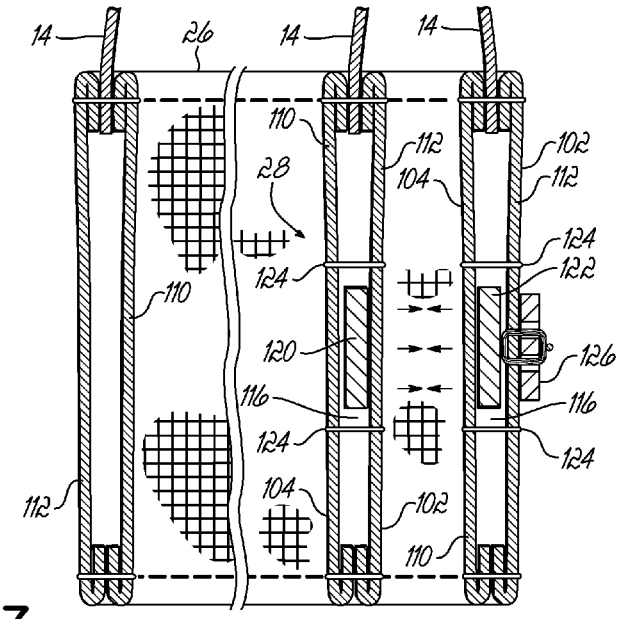
FIG. 7 is a cross sectional view taken along line 7-7 of the fastening assembly of FIG. 6.

With respect to FIGS. 2-3A, a magnified view of a portion of the fastening assembly 16 at the midline 20 of the article 10 is shown. FIGS. 2 and 2A show the portion of the fastening assembly 16 in engaged and disengaged configurations, respectively. The fastening assembly 16 includes at least one magnetic fastening assembly 18 having two solid magnetic elements 42, 44 without openings therethrough. One magnetic element 42 is associated with the left placket 20 of the article 10, and another magnetic element 44 is associated with the right placket 22 of the article 10.

At least one of the magnetic elements 42, 44 is a magnet. The magnet may be an axially magnetized neodymium magnet, for example. One suitable magnet is an N52 magnet sold by K&J Magnetics, Inc., for example. The magnet may have a maximum energy product (BHmax) of at least 49.5-52 megagauss-oersteds (MGOe). The magnet should be strong enough so that the fastening assembly 16 remains closed during normal wear of the article of clothing 10. However, the magnet should not be so strong as to prevent disengagement or cause undue exertion when the wearer wishes to disengage the fastening assembly to take off the article 10. It should be noted that due to the magnetic properties of the magnetic assembly 18, the fastening assembly 16 may not be safe for use on dress shirts or articles worn by people with pacemakers.

The magnet may be plated so as to help prevent corrosion and/or to help strengthen the magnet material. In one embodiment, a neodymium magnet is coated with nickel or plastic, yet other options for coatings include zinc, tin, copper, epoxy, silver, and gold, for example. Finally, although a standard temperature magnet is likely sufficient for use in the magnetic fastening assembly 18 for the article 10, a magnet having a temperature rating that enables the magnet to be employed at an increased operating temperature may also be used.

The other magnetic element 42, 44 may be another magnet having an opposite polarity than the first magnetic element 42, 44 or a metallic article that is magnetically attracted to the first magnetic element 42, 44. The two magnetic elements 40, 42 may have the same size and shape. In the embodiment shown in FIGS. 2-3A, the magnetic elements 40, 42 are disc-shaped. For example, the magnet may have a diameter of approximately 7/16" and a thickness of approximately 1/16". However, one of ordinary skill will recognize that a variety of sizes and/or shapes may be used for the magnetic elements 40, 42 and that the sizes and/or shapes of the two magnetic elements 40, 42 need not be identical.

In the embodiment of the fastening assembly 16 shown in FIGS. 3 and 3A, the right placket 22 is formed from the sheet of material 32 that forms the main body portion 12 of the article 10. An end portion 36 of the sheet of material 32 is folded at point 52 toward the interior and distal from the midline 24 so as to form a placket 22 with two layers 54, 56. The two layers 54, 56 are coupled together so as to form a pocket 58 between the two layers 54, 56. In the embodiment shown, a line of stitching 60 couples the folded end portion 36 to the sheet of material 32 proximate an end 50 of the sheet of material 32. Alternatively, the right placket 22 may comprise a strip of material that is folded to create the two layers 54, 56, which is then coupled to the sheet of material 32. Or the right placket 22 may comprise two strips of material that are coupled together to create the two layers 54, 56, which are then coupled to the sheet of material 32. One of ordinary skill in the art will recognize that the layers 54, 56 may be coupled to each other and/or to the sheet of material 32 by stitching or by any other satisfactory method.

A plurality of magnetic elements 44 of the magnetic assembly 18 may be positioned at predetermined locations in the pocket 58 between the two layers 54, 56 of material in the right placket 22. The magnetic elements 44 may be evenly spaced or spaced at varying intervals. Each magnetic element 44 may be secured in the proper position by sewing together the two layers 54, 56 outside at least a portion of the perimeter of the magnetic element 44. A resulting line of stitching 62 may form a rectangle around the magnetic element 44, may have the same shape as the magnetic element 44, or it may have any other shape suitable for restricting movement of the magnetic element 44 within the pocket 58. The line of stitching 62 around the magnetic element 44 indirectly couples the magnetic element 44 to the placket 22. In this way, it is not necessary to sew through the magnetic element 44 itself and, thus, the magnetic element 44 may be solid piece without holes therethrough.

With further reference to the embodiment shown in FIGS. 3 and 3A, the left placket 20 is also formed from the same sheet of material 32, at a left end portion 34 thereof. The end portion 34 is folded once at point 72 toward the exterior and distal from the midline 24 and then folded again at point 74 toward the exterior and proximal to the midline 24. As a result of the double fold, a three layer placket is formed. These layers 76, 78, 80 may be described as an inside layer 76, which is closest to the body when worn; an outside layer 80, which is furthest from the body when worn; and a middle layer 78, which lies between the inside and outer layers 76, 80. The three layers 76, 78, 80 may be coupled together so as to create at least one pocket 82 between two adjacent layers. Finally, an edge 70 of the sheet of material 32 may also be folded toward the interior at point 84, such that the edge 70 lies within a pocket between the layers 78, 80 and, thus, is not exposed at an exterior surface 38 of the placket 20. Folding edge 70 toward the interior at point 84 may help prevent the edge 70 from fraying. In the embodiment shown, a line of stitching 86 may couple the layers 76, 78, 80 and the edge 70 proximate the fold points 72, 84 and couple the layers 76, 78, 80 to the sheet of material 32 proximate the fold point 74. Similar to the right placket 22, the left placket 20 may alternatively comprise a strip of material that is folded to create three layers 76, 78, 80, the strip then being coupled to the sheet of material 32. Or the right placket 20 may comprise two or three strips of material that are coupled together to create three layers 76, 78, 80, which are then coupled to the dress shirt 10. One of ordinary skill will recognize that the layers 76, 78, 80 may be coupled to each other and/or to the sheet of material 32 by stitching or by any other satisfactory method.

A plurality of magnetic elements 42 of the magnetic assembly 18 may be positioned at predetermined locations in the pocket 82 between the layers 76, 78, 80 of material in the left placket 20. The locations of the magnetic elements 42 should correspond to the locations of the magnetic elements 44, and like the magnetic elements 44, the magnetic elements 42 may be evenly spaced or spaced at varying intervals. In the embodiment shown in FIGS. 3 and 3A, the magnetic element 42 is positioned between the inside layer 76 and the middle layer 78. However, the magnetic element 42 may alternatively be positioned between the middle layer 78 and the outside layer 80, so long as the magnetic attraction is strong enough to pass through an additional layer of material (i.e., both the inside and middle layers 76, 78). The magnetic element 42 may be secured in the proper position by stitching together the two surrounding layers 76, 78, 80 to form a line of stitching 88 outside at least a portion of the perimeter of the magnetic element 42 in the same manner as described above with respect to the right placket 22.

With further reference to FIGS. 2-3A, a button 90 may be coupled to the exterior surface 38 of the outside layer 80. The button 90 may be positioned immediately on top of the magnetic element 42, or the button 90 may be positioned at a distance from the magnetic element 42. The button 90 may be sewn onto the outside layer 80 or coupled thereto in any other way known to one of ordinary skill. The button 90 may be considered a "faux button" because it does not have a fastening or securing function for the article 10. The button 90 is provided for aesthetic purposes and to give the appearance of functional buttons. Although a four-hole button 90 is shown in the illustrated embodiment, one of ordinary skill will recognize that any type of button 90 may be used.

Figure 4:
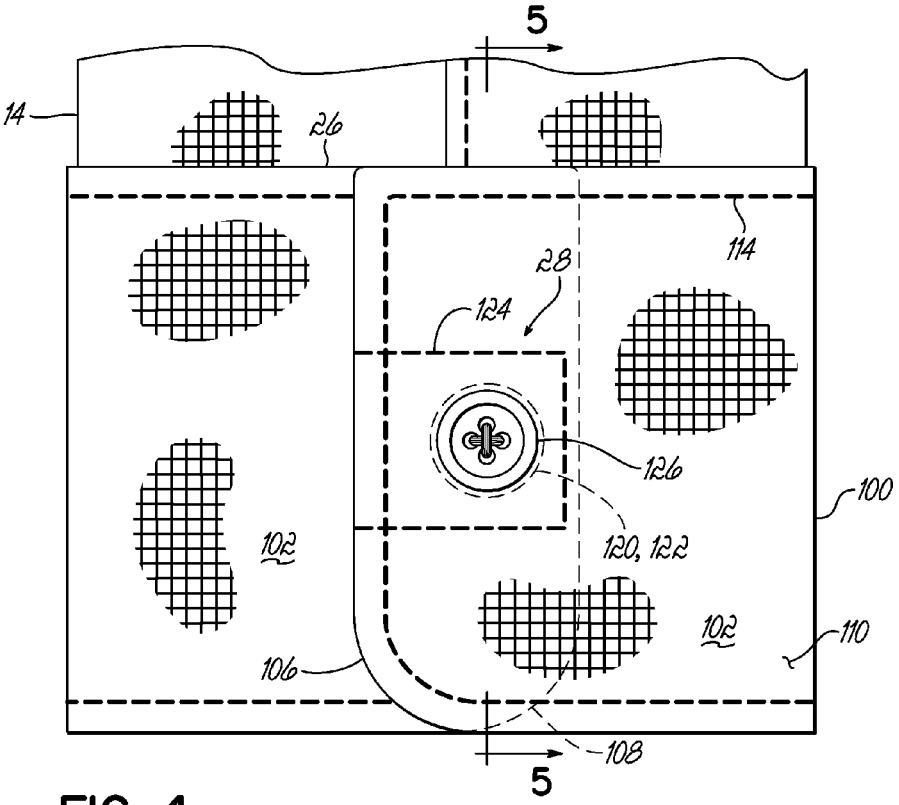
FIG. 4 is a front view of a cuff of an article of clothing, such as a dress shirt having a magnetic fastening assembly.
Figure 5:
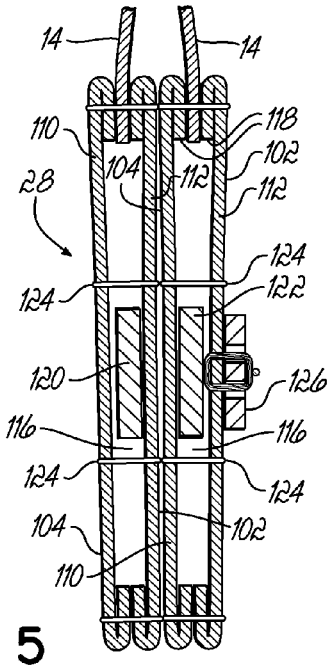
FIG. 5 is a cross-sectional view taken along line 5-5 of the fastening assembly of FIG. 4.

With reference to FIGS. 4-7, a similar fastening assembly as that described above with respect to the main body portion 12 of the article 10 may also be used on the cuffs 26. A cuff 26 may comprise a band 100 of material that is coupled to a distal portion of a sleeve 14. The band 100 has an exterior surface 102, which faces away from the person's body, and an interior surface 104, which faces the person's body. The band 100 may be considered to have two end portions 106 adjacent an opening of the cuff 26. The band 100 may be formed from two layers 110, 112 of material of substantially the same size that are sewn or otherwise coupled together. For example, the two layers 110, 112 may be coupled by a seam 114 proximate the perimeters of the layers 110, 112. Alternatively, the band 100 may be formed from a single piece of material that is folded lengthwise so as to create two layers 110, 112, which are then coupled together. In the embodiment shown in FIG. 5, the material at the distal portion of the sleeve 14 is sewn in between the two layers 110, 112 of the band 100, so as to secure the band 100 to the sleeve 14. One of ordinary skill will recognize that the band 100 may be secured to the sleeve 14 in a variety of ways. Regardless of how the two layers 110, 112 are formed and secured to the sleeve 14, at least one pocket 116 is formed between the two layers 110, 112. Moreover, as shown in the embodiment of FIG. 5, one or more edges 118 of the layers 110, 112 of material may be folded toward the pocket 116 of the band 100 so that the edges 118 are not exposed at the exterior or interior surfaces 102, 104 of the band 100. Such folding may help prevent fraying of the edges 118.

Similar to the magnetic assembly 18 described above, the fastening assembly 28 for the cuff 26 may also include a magnetic assembly 30 having two magnetic elements 120, 122. One magnetic element 120 of the magnetic assembly 30 may be coupled to one end portion 106 of the band 100, and another magnetic element 122 of the magnetic assembly 30 may be coupled to the other end portion 108 of the band 100. The magnetic elements 120, 122 may be positioned in the pocket 116 between the two layers 100, 112 of material, and sewing together the two layers 110, 112 in a line of stitching 124 around the magnetic elements 120, 122 may secure the magnetic elements 120, 122 in substantially stationary positions. As described above with respect to the plackets 20, 22, the line of stitching 124 may have a variety of different shapes around at least a portion of the perimeter of the magnetic element 120, 122. A button 126 may be coupled to an exterior surface 102 of the band 100 at the end portion 106 thereof. The button 126 may be secured on the cuff 26 in the manner described above with respect to button 90.

In the embodiment of the cuff 26 shown in FIG. 4, when the magnetic elements 120, 122 of the magnetic assembly 30 are coupled together, one end portion 106 of the band 100 overlaps the other end portion 108 of the band 100, as is common with traditional button cuffs. With the magnetic fastening assembly 28, the band 100 may be a solid piece, without button holes. However, one may use the fastening assembly 28 of the present invention for link cuffs, including single cuffs, French cuffs, or convertible cuffs, as well.

An article 10 may include a fastening assembly 16 on a body portion 12 and/or a fastening assembly 28 on each of the cuffs 26. In use, after one positions his/her arms in the sleeves 14, he/she aligns an uppermost magnetic element 42 on the left placket 20 with the corresponding magnetic element 44 on the right placket 22. By bringing the uppermost magnetic elements 42, 44 in close proximity to one another, they become magnetically coupled together. Moreover, once the magnetic elements 42, 44 of the uppermost magnetic assembly 18 are aligned, the magnetic elements 42, 44 of the remaining magnetic assemblies 18 may fall into place, self-align, and automatically magnetically couple together. Accordingly, little dexterity is required to secure the fastening assembly 16 of the article 10.

To close the cuffs 26 of the article 10, the person aligns the magnetic element 120 on one end portion 106 of the cuff band 100 with the magnetic element 122 on the other end portion 108 of the cuff band 100 so that the magnetic elements 120, 122 magnetically couple together when they are brought in close proximity to one another. If there is more than one magnetic assembly 30 on each cuff 26, once the magnetic elements 120, 122 of the first magnetic assembly 30 are aligned, any subsequent magnetic assemblies 30 may self align and magnetically couple together as well. In the embodiment in which buttons 90, 126 are coupled to exterior surfaces 38, 102 of the left placket 20 and/or cuffs 26, the article 10 will have an appearance of a regular dress shirt, coat or jacket.

In the engaged configuration, at least two layers of material are positioned between the two magnetic elements of the magnetic assembly. Accordingly, the magnetic elements 42, 44 or 120, 122 are not in direct contact with each other. Although the magnetic assemblies 18, 30 have strong enough magnetic properties to maintain the fastening assemblies 16, 28 in engaged configurations while the article 10 is worn, the magnetic assemblies 18, 30 may be disengaged with a reasonable amount of force. Therefore, to remove the dress shirt 10, the person simply pulls apart the magnetic elements 42, 44 or 120, 122 of the magnetic assembly 18, 30. With respect to the magnetic assemblies 18 on the plackets 20, 22 of the article 10, one may separate the magnetic elements 42, 44, for example, by pulling the left placket 20 away from the body or away from the midline 24. The buttons 90, 126 may also be gripped to separate the elements 42, 44 or 120, 122. Accordingly, little dexterity is required to disengage the fastening assembly 16 of the article 10.

Figure 8:
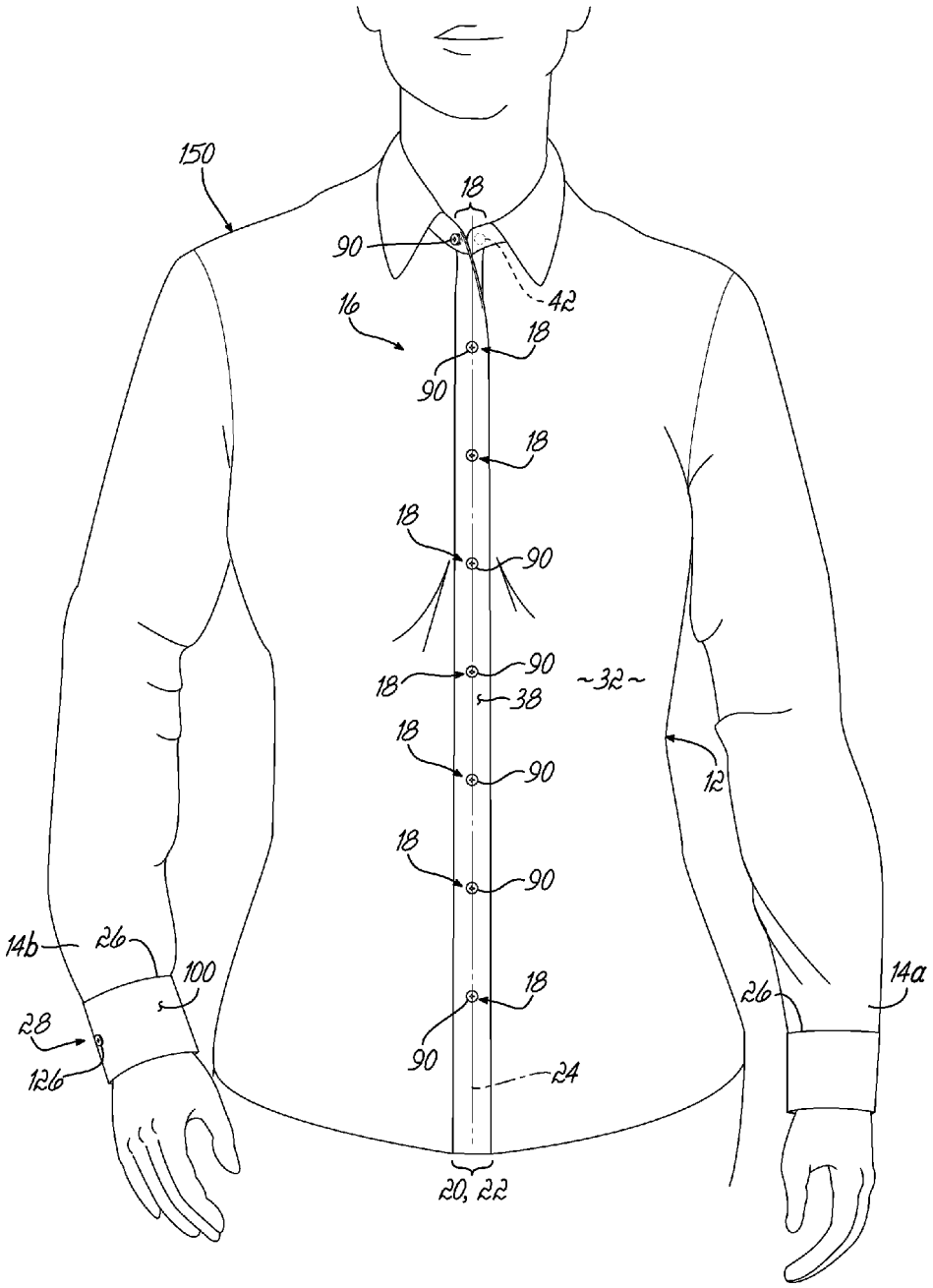
FIG. 8 is a front view of an article of clothing, such as a women's blouse according to aspects of the present invention.

FIG. 8 shows a fastening assembly 16 on an article of clothing shown as a women's blouse 150. The fastening assembly 16 functions the same way on a women's blouse 150 as on a men's dress shirt 10, but fewer magnetic assemblies 18 may be used and/or the magnetic assemblies 18 may be positioned closer together on the women's blouse 150 than on the men's dress shirt 10.

Figure 9:
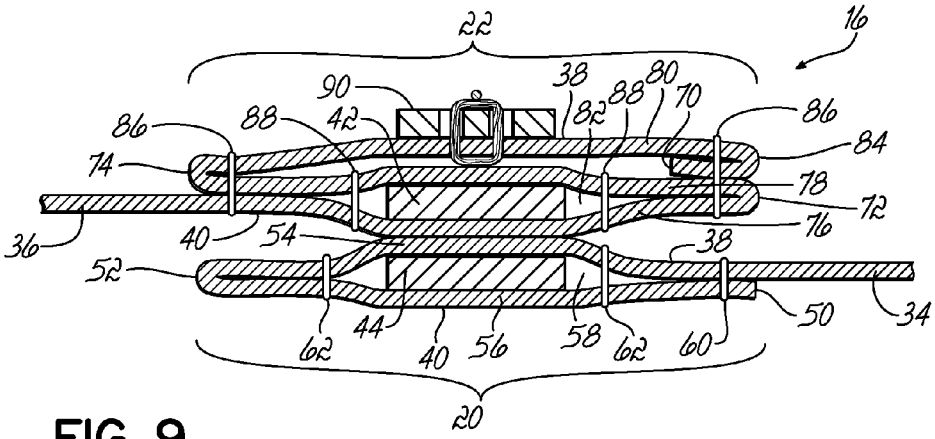
FIG. 9 is a cross-sectional view like FIG. 3 of the blouse of FIG. 8.

As shown in FIG. 9, the main difference between the women's blouse 150 and the men's dress shirt 10 is that the right placket 22 is designed to be positioned on top of the left placket 20 in the engaged configuration for a women's blouse 150. In this way, the interior surface 40 of the right placket 22 faces and is positioned substantially adjacent the exterior surface 38 of the left placket 20. On article 150, the right placket 22 is designed to be positioned on top of the left placket 20 in the closed position. Due to the magnetic function of the fastening assembly 16, the plackets 20, 22 may be solid pieces of material, without button holes therethrough.

In the embodiment of the fastening assembly 16 shown in FIGS. 8 and 9, the left placket 20 is formed from the sheet of material 32 that forms the main body portion 12 of the article 150. An end portion 34 of the sheet of material 32 is folded at point 52 toward the interior and distal from the midline 24 so as to form a placket 20 with two layers 54, 56. The two layers 54, 56 are coupled together so as to form a pocket 58 between the two layers 54, 56. In the embodiment shown, a line of stitching 60 couples the folded end portion 36 to the sheet of material 32 proximate an end 50 of the sheet of material 32. Alternatively, the left placket 20 may comprise a strip of material that is folded to create the two layers 54, 56, which is then coupled to the sheet of material 32. Or the left placket 20 may comprise two strips of material that are coupled together to create the two layers 54, 56, which are then coupled to the sheet of material 32. One of ordinary skill in the art will recognize that the layers 54, 56 may be coupled to each other and/or to the sheet of material 32 by stitching or by any other satisfactory method.

A plurality of magnetic elements 44 of the magnetic assembly 18 may be positioned at predetermined locations in the pocket 58 between the two layers 54, 56 of material in the left placket 20. The magnetic elements 44 may be evenly spaced or spaced at varying intervals. Each magnetic element 44 may be secured in the proper position by sewing together the two layers 54, 56 outside at least a portion of the perimeter of the magnetic element 44. A resulting line of stitching 62 may form a rectangle around the magnetic element 44, may have the same shape as the magnetic element 44, or it may have any other shape suitable for restricting movement of the magnetic element 44 within the pocket 58. The line of stitching 62 around the magnetic element 44 indirectly couples the magnetic element 44 to the placket 22. In this way, it is not necessary to sew through the magnetic element 44 itself and, thus, the magnetic element 44 may be a solid piece without holes therethrough.

With further reference to the embodiment shown in FIGS. 8 and 9, the right placket 22 is also formed from the same sheet of material 32, at a right end portion 36 thereof. The end portion 36 is folded once at point 72 toward the exterior and distal from the midline 24 and then folded again at point 74 toward the exterior and proximal to the midline 24. As a result of the double fold, a three-layer placket is formed. These layers 76, 78, 80 may be described as an inside layer 76, which is closest to the body when worn; an outside layer 80, which is furthest from the body when worn; and a middle layer 78, which lies between the inside and outer layers 76, 80. The three layers 76, 78, 80 may be coupled together so as to create at least one pocket 82 between two adjacent layers. Finally, an edge 70 of the sheet of material 32 may also be folded toward the interior at point 84, such that the edge 70 lies within a pocket between the layers 78, 80 and, thus, is not exposed at an exterior surface 38 of the placket 22. Folding edge 70 toward the interior at point 84 may help prevent the edge 70 from fraying. In the embodiment shown, a line of stitching 86 may couple the layers 76, 78, 80 and the edge 70 proximate the fold points 72, 84 and couple the layers 76, 78, 80 to the sheet of material 32 proximate the fold point 74. Similar to the left placket 20, the right placket 22 may alternatively comprise a strip of material that is folded to create three layers 76, 78, 80, the strip then being coupled to the sheet of material 32. Or the left placket 22 may comprise two or three strips of material that are coupled together to create three layers 76, 78, 80, which are then coupled to the dress shirt 10. One of ordinary skill will recognize that the layers 76, 78, 80 may be coupled to each other and/or to the sheet of material 32 by stitching or by any other satisfactory method.

A plurality of magnetic elements 42 of the magnetic assembly 18 may be positioned at predetermined locations in the pocket 82 between the layers 76, 78, 80 of material in the right placket 22. The locations of the magnetic elements 42 should correspond to the locations of the magnetic elements 44, and like the magnetic elements 44, the magnetic elements 42 may be evenly spaced or spaced at varying intervals. In the embodiment shown in FIGS. 8 and 9, the magnetic element 42 is positioned between the inside layer 76 and the middle layer 78. However, the magnetic element 42 may alternatively be positioned between the middle layer 78 and the outside layer 80, so long as the magnetic attraction is strong enough to pass through an additional layer of material (i.e., both the inside and middle layers 76, 78). The magnetic element 42 may be secured in the proper position by stitching together the two surrounding layers 76, 78, 80 to form a line of stitching 88 outside at least a portion of the perimeter of the magnetic element 42 in the same manner as described above with respect to the left placket 20.

The blouse 150 (or the dress shirt 10, for that matter) may not include buttons 90 at all, or the buttons 90 may be concealed by an additional placket of material that is positioned over the buttons 90. The same may be true on a coat or jacket like the jacket shown in FIG. 10.

Figure 10:
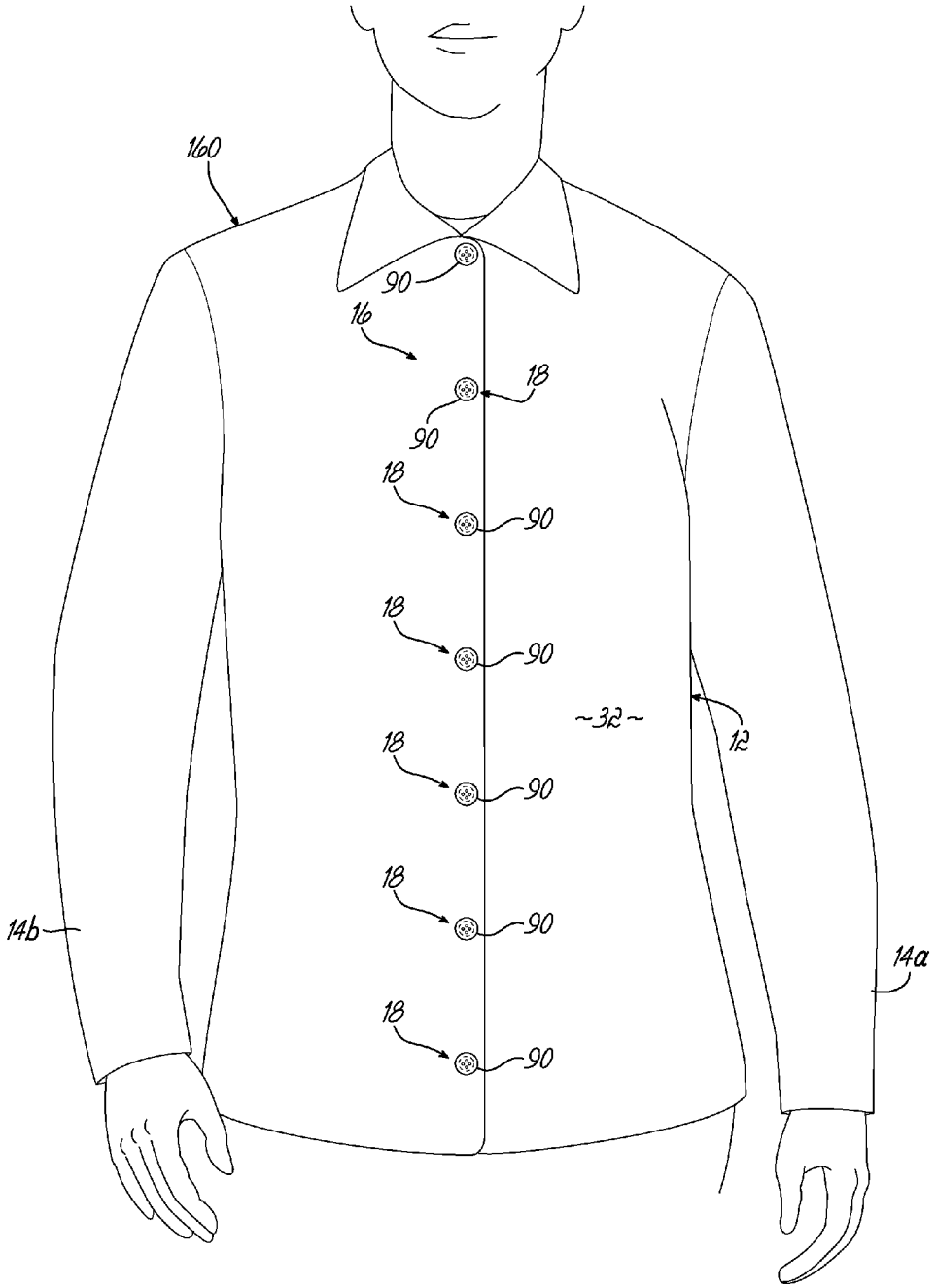
FIG. 10 is a front view of an article of clothing, such as a jacket according to aspects of the present invention.

FIG. 10 shows a fastening assembly 16 on an article of clothing shown as a jacket 160. The fastening assembly 16 functions the same way on a jacket 160 as on the women's blouse 150, but more magnetic assemblies 18 may be used and/or the magnetic assemblies 18 may be positioned closer together on the jacket 160 than on the women's blouse 150. The main difference between the jacket 160 and the men's dress shirt 10 is that the right placket 22 is designed to be positioned on top of the left placket 20 in the engaged configuration for a jacket 160, like for the women's blouse 150. In this way, the interior surface 40 of the right placket 22 faces and is positioned substantially adjacent the exterior surface 38 of the left placket 20. As shown in FIG. 10, the jacket 160 may lack cuffs on the left and right sleeves, 14*a*, 14*b*, respectively.

A person of ordinary skill will recognize that the principles of the present invention may be used with the childrens' dress shirts, coats and jackets as well, for example with fewer magnetic assemblies 18 and/or with less distance between the magnetic assemblies 18. The drawings are not intended to limit the present invention to clothing of any particular size. The drawings merely illustrate examples. The articles of clothing shown may be any desired sizes, including children's sizes.

While I have described several preferred embodiments of the present invention, persons skilled in the art will appreciate changes and modifications which may be made without departing from the spirit of the invention. Therefore, I intend to be limited only by the scope of the following claims and equivalents thereof:

I claim:

1. An article of clothing comprising:

a sheet of material having a body portion with opposed first and second end portions, the first end portion of the sheet being folded once and secured to itself with a line of stitching proximate a first edge of the sheet to create a first placket having one fold, the first placket comprising an inside layer of the first placket adapted to be closest to the body when worn and an outside layer of the first placket coupled together to form a first pocket between the inside and outside layers of the first placket, the first edge of the sheet being on the inside layer of the first placket and the outside layer of the first pocket being a first extension of the body portion of the sheet prior to the one fold of the first placket;

the second end portion of the sheet being folded three times and secured to itself by two parallel lines of stitching parallel a second edge of the sheet to create a second placket having three folds, the two parallel lines of stitching and each of the three folds of the second placket being equidistant from a midline of the second placket, the two parallel lines of stitching comprising a first and second line of stitching, the first line of stitching closest to the edge of the sheet and passing through four layers and the second line of stitching of the second placket passing through three layers of the second placket, the second placket comprising an inside layer of the second placket adapted to be closest to the body when worn, the inside layer of the second placket being a second extension of the body portion of the sheet prior to one of the three folds of the second placket, an outside layer of the second placket adapted to be furthest from the body when worn and a middle layer of the second placket between the inside and outside layers of the second placket, a second pocket being located between the inside and middle layers of the second placket and a third pocket being located between the middle and outside layers of the second placket, the second edge of the sheet being located in the third pocket; and a plurality of spaced magnetic fastening assemblies including a plurality of first magnetic elements secured inside the first pocket and a plurality of second magnetic elements secured inside the second pocket, each of the first magnetic elements being secured in position by stitching the inside and outside layers of the first placket around a perimeter of the first magnetic element between the line of stitching of the first placket and the fold of the first placket for restraining movement of the first magnetic element and each of the second magnetic elements being secured in position in the second pocket by stitching only the inside and middle layers of the second placket around a perimeter of the second magnetic element between the two parallel lines of stitching of the second placket for restraining movement of the second magnetic element;

at least some of the first magnetic fastening assemblies being adapted to engage with corresponding second magnetic fastening assemblies to close the article of clothing around a person's body, the positions of the second magnetic elements corresponding to the positions of the first magnetic elements, the second placket overlaying the first placket such that the stitches securing the magnetic elements in place are not visible from an exterior of the article of clothing when the article is closed; and a plurality of buttons coupled to only the outside layer of the second placket to provide the appearance of a regular article of clothing without magnets.

2. The article of claim 1, wherein the stitching around the perimeter of the first magnetic element for restraining movement of the first magnetic element is rectangular.

3. The article of claim 2, wherein the stitching around the perimeter of the second magnetic element for restraining movement of the second magnetic element is rectangular.

4. The article of claim 1, wherein the first and second magnetic elements are disc shaped.

5. The article of claim 1, wherein the first placket is on the right side of the article of clothing.

6. The article of claim 1, wherein the second placket is on the left side of the article of clothing.

7. The article of claim 1, wherein the first and second magnetic elements of the magnetic assembly are solid pieces.

8. The article of claim 1, wherein at least one of the first and second magnetic elements is a magnet having a maximum energy product greater than or equal to 49.5 MGOe.

9. The article of claim 1, wherein at least one of the first and second magnetic elements is a neodymium magnet.

10. The article of claim 9, wherein the neodymium magnet is coated with nickel.

11. The article of claim 1, wherein each magnet is coated with plastic.

12. The article of claim 1, wherein in a closed position, an interior surface of the second placket faces and is positioned substantially adjacent an exterior surface of the first placket.

13. The article of claim 1, further comprising:

a pair of sleeves;

a cuff located at a distal end of each sleeve; and each cuff is fastened using magnets.

14. An article of clothing comprising:

a sheet of material having portion with opposed first and second end portions, the first end portion of the sheet being folded once and secured to itself with a line of stitching proximate a first end of the sheet, to create a first placket having one fold, the line of stitching being spaced from and parallel to the one fold, the first placket comprising an inside layer of the first placket and an outside layer of the first placket coupled together to form a first pocket between the inside and outside layers of the first placket and between the one fold and the line of stitching, the line of stitching and the one fold of the first placket being equidistant from a midline of the article of clothing when the article is closed;

the second end portion of the sheet being folded three times and secured to itself by two parallel lines of stitching parallel an edge of the sheet to create a second placket, the two parallel lines of stitching and each of the three folds of the second placket being equidistant from the midline of the article of clothing when the article is closed, the second placket comprising an inside layer of the second placket, an outside layer of the second placket and a middle layer of the second placket, the middle layer of the second placket being between the inside and outside layers of the second placket, a second pocket being located between the inside and middle layers of the second placket and a third pocket being located between the middle and outside layers of the second placket, the edge of the sheet being located in the third pocket;

a plurality of spaced magnetic fastening assemblies including a plurality of first magnetic elements secured inside the first pocket and a plurality of second magnetic elements secured inside the second pocket, each of the first magnetic elements being secured in position by stitching the inside and outside layers of the first placket around the first magnetic element between the line of stitching and the one fold of the first placket for restraining movement of each of the first magnetic elements, and each of the second magnetic elements being secured in position in the second pocket by stitching only the inside and middle layers of the second placket around the second magnetic element between the two parallel lines of stitching of the second placket for restraining movement of each of the second magnetic elements, at least some of the first magnetic fastening assemblies adapted to be attracted to corresponding second magnetic fastening assemblies to close the article of clothing around a person's body, the positions of the second magnetic elements corresponding to the positions of the first magnetic elements wherein when the article of clothing is closed the stitching around the magnetic elements is not visible from an exterior of the article of clothing; and a plurality of buttons coupled to only the outside layer of the second placket to provide the appearance of a regular article of clothing without magnets.

15. The article of claim 14, the two parallel lines of stitching of the second placket comprises a first line of stitching and a second line of stitching, the first line of stitching being closest to the edge of the sheet and passes through four layers and the second line of stitching of the second placket passes through three layers.

16. The article of claim 14, wherein the stitching of the inside and outside layers of the first placket around the first magnetic element is rectangular.

17. The article of claim 14, wherein the stitching of the inside and middle layers of the second placket around the second magnetic element is rectangular.

18. The article of claim 14, wherein the first and second magnetic elements are disc shaped.

19. An article of clothing comprising:

a sheet of material forming a body portion, the sheet of material having first and second end portions movable between open and closed positions, a first placket integrally formed on the body portion of the sheet of material and comprising the first end portion of the sheet folded and secured to itself by a line of stitching spaced from a fold, the first placket comprising an inside layer of the first placket adapted to be closest to the body when worn and an outside layer of the first placket coupled together to form a first pocket between the inside and outside layers of the first placket and between the fold and line of stitching, a second placket integrally formed on the body portion of the sheet of material and comprising the second end portion of the sheet folded three times to form three folds and secured to itself by two parallel lines of stitching parallel an edge of the sheet, one of the two parallel lines of stitching passing through four layers and another of the two parallel lines of stitching passing through three layers, the second placket comprising an inside layer of the second placket adapted to be closest to the body when worn, an outside layer of the second placket adapted to be furthest from the body when worn and a middle layer of the second placket between the inside and outside layers of the second placket, the inside and middle layers of the second placket being coupled together to form a second pocket between the inside and middle layers of the second placket, the two parallel lines of stitching and the three folds being equidistant from a midline of the second placket, the two parallel lines of stitching comprising a first line of stitching and a second line of stitching, the first line of stitching being closest to the edge of the sheet and passing through four layers of the second placket and the second line of stitching passing through three layers of the second placket;

a plurality of spaced magnetic fastening assemblies including a plurality of first magnetic elements secured inside the first pocket and a plurality of second magnetic elements secured inside the second pocket, each of the first magnetic elements being secured in position by stitching only the inside and outside layers of the first placket outside the first magnetic element between the line of stitching and the fold of the first placket and each of the second magnetic elements being secured in position by stitching the inside and middle layers of the second placket outside the second magnetic element between the two parallel lines of stitching of the second placket, the magnetic fastening assemblies being engaged when the article of clothing is closed around a person's body, the positions of the second magnetic elements corresponding to the positions of the first magnetic elements, wherein when the article of clothing is closed, the second placket overlays the first placket such that the stitching around the magnetic elements is not visible from an exterior of the article of clothing; and buttons coupled to only the outside layer of the second placket to provide the appearance of a regular article of clothing without magnets.

20. The article of claim 19, wherein the stitching outside the first magnetic element is rectangular and the stitching outside the second magnetic element is rectangular.

21. The article of claim 19, wherein the first and second magnetic elements are disc shaped with no holes.

22. The article of claim 19, further comprising a pair of sleeves, a cuff being located at a distal end of each sleeve and each cuff is fastened using magnets.

23. The article of claim 19, wherein the first and second magnetic elements of the magnetic assembly are solid pieces.

* * * * *

UNITED STATES PATENT AND TRADEMARK OFFICE

CERTIFICATE OF CORRECTION

PATENT NO. : 9,210,953 B2
APPLICATION NO. : 13/674542
DATED : December 15, 2015
INVENTOR(S) : Maura M. Horton It is certified that error appears in the above-identified patent and that said Letters Patent is hereby corrected as shown below:

In the Claims

Column 11

Line 15, "having portion" should be ---having a portion---.

Signed and Sealed this
Twenty-sixth Day of April, 2016

Michelle K. Lee

Michelle K. Lee
*Director of the United States Patent and Trademark Office*